United States Patent [19]

Busse et al.

[11] 4,265,171

[45] May 5, 1981

[54] APPARATUS FOR CONVEYING AND DEWATERING WET COARSE SCREENINGS DEBRIS

[75] Inventors: Oswald Busse; Hugo Klesper, both of Aarbergen, Fed. Rep. of Germany

[73] Assignee: Passavant-Werke Michelbacher Huette, Fed. Rep. of Germany

[21] Appl. No.: 60,917

[22] Filed: Jul. 26, 1979

[30] Foreign Application Priority Data

Aug. 14, 1978 [DE] Fed. Rep. of Germany ... 7824274[U]

[51] Int. Cl.[3] ..... B30B 9/06

[52] U.S. Cl. ..... 100/118; 100/126; 100/151

[58] Field of Search ..... 100/104, 116, 118, 121, 100/126, 151, 152, 154

[56] References Cited

U.S. PATENT DOCUMENTS

| | | | |
|---|---|---|---|
| 1,883,449 | 10/1932 | Andrews | 100/151 X |
| 3,106,152 | 10/1963 | Coffelt | 100/118 |
| 3,230,866 | 1/1966 | Branders et al. | 100/118 X |
| 3,680,476 | 8/1972 | Pfeiffer | 100/118 X |
| 3,929,065 | 12/1975 | Csordas et al. | 100/118 X |
| 4,033,253 | 7/1977 | Stollenwerk et al. | 100/118 |
| 4,114,531 | 9/1978 | Plaut | 100/118 X |

*Primary Examiner*—Christopher K. Moore

*Attorney, Agent, or Firm*—Woodford R. Thompson, Jr.

[57] ABSTRACT

Apparatus for conveying and dewatering wet coarse screenings debris comprises a drag chain conveyor having a conveying flight. A pressing unit is mounted above the conveying flight and exerts a downward pressure on the debris. A trough having a perforated bottom is mounted beneath the conveying flight in the vicinity of the pressing unit.

8 Claims, 2 Drawing Figures

APPARATUS FOR CONVEYING AND DEWATERING WET COARSE SCREENINGS DEBRIS

BACKGROUND OF THE INVENTION

This invention relates to apparatus for conveying and dewatering wet coarse debris of the type occuring principally at the inlet of sewage treatment plants. Such debris is in the form of screenings which are removed by conventional screens and then transported to tips or are used for incineration. In both cases substantial dewatering is necessary since transport of the wet screenings is unsanitary.

As is well known, screenings can be passed to a screenings press and dewatered therein under increased pressure. However, in most cases, the screenings press is located a substantial distance from the screen, such as in the vicinity of the incinerator. The screenings must thus be transported in a vehicle to this location.

SUMMARY OF THE INVENTION

In accordance with our invention, the task of dewatering the screenings in the immediate vicinity of the screen is solved by a drag chain conveyor operating within a trough and having a pressing unit in the vicinity of the conveying side thereof which acts on the coarse screenings from above by means of spring pressure with the base of the trough in this vicinity being pervious. While drag chain conveyors having supporting floors at the conveying side thereof in the form of sieves are well known, the time period in which the screenings are conveyed above such floor level, and the gravity forces acting on the screenings are not sufficient to dewater the screenings sufficiently. Accordingly, such screenings are still wet upon leaving such drag conveyors.

An advantage in our improved apparatus is that it can be employed to provide a substantial degree of dewatering at a minimum cost.

Our pressing unit is preferably in the form of a pressure plate having a width conforming generally to that of the trough. It is advantageous to mount this pressure plate so that it pivots about a horizontal axis located in the vicinity of the inlet and is loaded by pressure springs or other suitable pressure means in the vicinity of the outlet. To achieve a continuous increase in pressure and to avoid blockages as far as possible, the pressure plate should preferably have a first curved inlet section, a second compression section approaching the drag chain at an acute angle, and a third outlet section extending or running parallel to the drag chain. To ensure that there is no friction between the pressure plate and the drag chain while there is little or no volume of screenings, a stop may be provided to hold the pressure plate at a short distance above the drag chain. In this connection, it can be of advantage to place a level detector in front of the pressure plate, with this level detector being connected to the drive for the drag chain conveyor to control its conveying speed. This level detector will switch the drag chain conveyor on to a lower conveying speed when the screenings feed is reduced a predetermined amount or is nonexistant.

DESCRIPTION OF THE DRAWING

Apparatus embodying features of our invention is illustrated in the accompanying drawing, in which.

DETAILED DESCRIPTION

Figure 1:
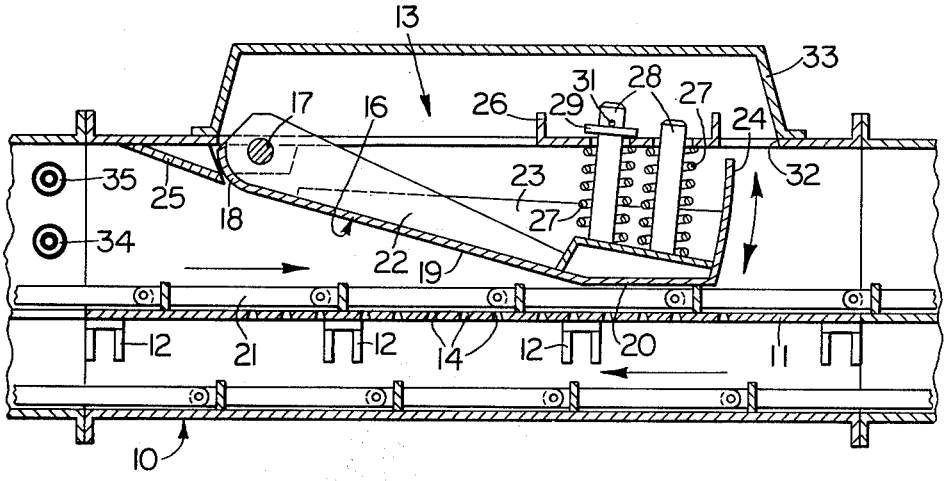
FIG. 1 is a longitudinal sectional view through the portion of a drag chain conveyor having our improved pressing unit; and, FIG. 2 is a longitudinal sectional view showing a modified form of our invention.

Referring now to the drawing, we show in FIG. 1 a housing section 10 in which our improved pressing unit is arranged. The housing section 10 is an independent housing section which may be separated from the other sections of the drag chain conveyor housing. The housing section 10 has an intermediate floor 11 which is supported by particularly strong brackets 12 to absorb the pressure exerted by our pressing unit, indicated at 13. The intermediate floor 11 is provided with holes 14 therethrough through which the extracted water flows. The water then collects on the base of the housing 10 which slopes downwardly towards the feed end of the housing section 10 whereby the water flows through a suitable discharge opening provided at this point.

The pressure device comprises a pressure plate 16 which pivots about a horizontal axis 17 located adjacent the front of the housing section 10. The plate 16 has a first section in the form of a curved inlet section 18, a second compression section 19 and a third outlet section 20 which extends or runs parallel to the drag chain, indicated at 21. To provide rigidity, ribs 22, 23 and a cover plate 24 are provided. Located in front of the pressure plate 16 is a deflector plate 25 which extends at an acute angle relative to the upper side of the housing 10 and generally tangent to the curved inlet section 18 of the pressure plate 16. Accordingly, we provide a continuous wedge-shaped feed area for receiving the screenings so as to prevent blockages.

Support brackets 26 are mounted on and extend transversely of the housing 10 above the outlet section 20 of the pressure plate 16. These brackets serve as spring abutments and supports for the pressure springs 27 which themselves surround and are guided by posts 28 carried by the pressure plate 16. A washer 29 surrounds and is secured by a pin 31 to one of these posts 28 and limits downward movement of the pressure plate 16 so that, in its lowest position it is out of contact with the drag chain 21. An opening 32 is provided in the housing 10 which permits access to the pressing unit 13 and is covered by a protective hood 33.

A level probe is mounted within the housing section 10 in front of the pressure plate 16. The level probe may be in the form of two conventional sensing devices 34 and 35 which may be of the ultrasonic or isotopic emitter type. The lower device 34 is for minimum filling and the upper device 35 is for maximum filling. If the thickness of the debris layer to be dewatered falls below the minimum, the drive for the conveyor will be stopped. If the thickness of this debris layer exceeds the maximum, the feeding of new debris into the fill box of the conveyor will be interrupted. Also, additional sensing devices may be located in the fill box.

Figure 2:
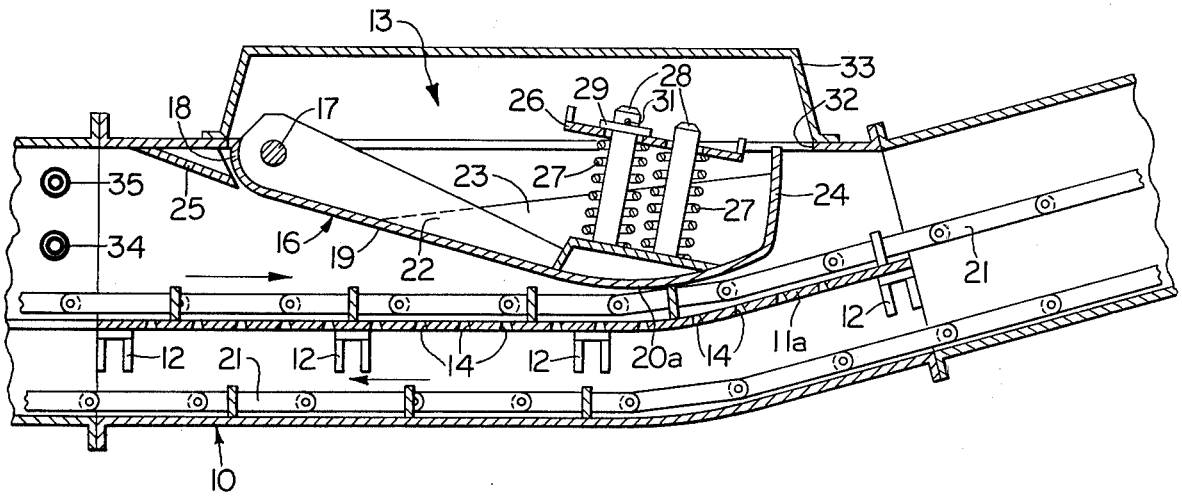

FIG. 2 we show a slightly modified form of our invention which is substantially identical to that shown in FIG. 1. The outlet section, indicated at **20*a* is curved upwardly instead of being generally flat as shown in FIG. 1. Also, the section of the drag chain conveyor 21 and the adjacent portion of the intermediate floor 11*a* beneath the outlet section 20*a* is curved corresponding generally to the curvature of the outlet section 20*a*. By providing this curvature, the drag chain conveyor ascends at an acute angle whereby the water which has been forced behind the pressure plate 16** can flow in counter-current relation to the direction of conveying and thus reach the outlet.

It will be understood that the pressing force can also be applied by other suitable means such as by conventional hydraulic cylinders which may be equipped with a conventional pressure adjustable limiting valve whereby the force exerted by the pressure plate 16 is the same in any position.

What we claim is:

1. In apparatus for conveying and dewatering wet coarse screenings debris embodying a drag chain conveyor having a conveying flight, the improvement comprising, (a) a pressing unit having a pressure plate mounted above said conveying flight and exerting a downward pressure on said wet coarse screenings debris, (b) a trough having a perforated bottom disposed subjacent said conveying flight in the vicinity of said pressure plate, and (c) said pressure plate being of a width generally conforming to that of said trough.

2. Apparatus for conveying and dewatering wet coarse screenings debris as defined in claim 1 in which said pressure plate is mounted for pivotal movement about a horizontal axis adjacent the end thereof at which said screenings debris passes therebeneath and is forced downward by pressure applying means adjacent the end thereof at which said screenings debris passes therefrom.

3. Apparatus for conveying and dewatering wet coarse screenings debris as defined in claim 2 in which said pressure applying means comprises a spring loaded unit.

4. Apparatus for conveying and dewatering wet coarse screenings debris as defined in claim 2 in which said pressure plate has an initial curved inlet section, an intermediate compression section approaching said drag chain in the direction of movement thereof at an acute angle, and an outlet section extending parallel to said drag chain.

5. Apparatus for conveying and dewatering wet coarse screenings debris as defined in claim 2, 3 or 4 in which stop means limits downward movement of said pressure plate at a small distance above said drag chain.

6. Apparatus for conveying and dewatering wet coarse screenings debris as defined in claim 4 in which a fixed deflecting plate is mounted in front of said curved inlet section of said pressure plate and extends tangentially to the curvature of said inlet section.

7. A conveyor for conveying and dewatering wet coarse screenings debris as defined in claim 4 in which said outlet section of said pressure plate is curved upwardly and the adjacent portion of said drag chain conveyor is also curved corresponding to the curvature of said outlet section of the pressure plate.

8. Apparatus for conveying and dewatering wet coarse screenings debris as defined in claim 1 in which a level probe is located in front of said pressing unit and is operatively connected to said drag chain conveyor to control the conveying speed thereof.

* * * * *